US005347061A

United States Patent [19]

Harandi et al.

[11] Patent Number: 5,347,061

[45] Date of Patent: Sep. 13, 1994

[54] PROCESS FOR PRODUCING GASOLINE HAVING LOWER BENZENE CONTENT AND DISTILLATION END POINT

[75] Inventors: Mohsen N. Harandi, Longhorne, Pa.; Hartley Owen, Worton, Md.; Paul H. Schipper, Doylestown, Pa.

[73] Assignee: Mobil Oil Corporation, Fairfax, Va.

[21] Appl. No.: 28,057

[22] Filed: Mar. 8, 1993

[51] Int. Cl.[5] ..... C07C 2/66

[52] U.S. Cl. ..... 585/323; 585/310; 585/467; 585/800; 208/62; 208/92; 208/100

[58] Field of Search ..... 585/804, 323, 322, 467, 585/800; 208/62, 92, 100

[56] References Cited

U.S. PATENT DOCUMENTS

| | | | |
|---|---|---|---|
| 3,759,821 | 9/1973 | Brennan et al. | 208/93 |
| 3,767,568 | 10/1973 | Chen | 208/134 |
| 3,950,242 | 4/1976 | Garwood et al. | 208/70 |
| 4,078,990 | 3/1978 | Brennan et al. | 585/322 |
| 4,784,745 | 11/1988 | Nace | 208/74 |
| 4,950,823 | 8/1990 | Harandi et al. | 585/323 |
| 5,120,890 | 6/1992 | Sachtler et al. | 585/323 |
| 5,210,348 | 5/1993 | Hsieh et al. | 585/467 |

*Primary Examiner*—Anthony McFarlane

*Attorney, Agent, or Firm*—A. J. McKillop; M. D. Keen

[57] ABSTRACT

A process is disclosed for upgrading reformate and/or light FCC gasoline by substantially reducing the amount of benzene in the gasoline product while simultaneously reducing the gasoline ASTM distillation End Point. The process comprises the fractionation of reformate to recover that fraction, $C_7$–$C_8$ hydrocarbons, directly useful in gasoline without further conversion. A heavy bottom fraction comprising $C_9$+ aromatic and non-aromatic hydrocarbons is recovered and a $C_6$ fraction rich in benzene. The total $C_6$ fraction and a portion of the $C_9$+ fraction are converted by alkylation, transalkylation and cracking in contact with acidic metallosilicate catalyst particles to gasoline boiling range materials rich in alkylaromatics. Following debutanization or depentanization of the conversion product, the fraction containing unconverted benzene is recycled to the reformate fractionator.

19 Claims, 1 Drawing Sheet

PROCESS FOR PRODUCING GASOLINE HAVING LOWER BENZENE CONTENT AND DISTILLATION END POINT

This invention relates to a process for the production of a more environmentally suitable gasoline as a consequence of novel process steps for the elimination of a substantial portion of benzene in gasoline while reducing the ASTM Distillation End Point. The achievement is carried out by fractionating reformate and subjecting the benzene containing fraction and the high end point fraction containing alkylaromatics and non-aromatics to simultaneous cracking, alkylation and transalkylation conditions in contact with shape selective metallosilicate catalyst particles.

Background of the Invention

The record of the development of environmental regulations at the Federal and State levels for the control of emissions from motor vehicles has moved from an early emphasis on end use control, as in the required application of catalytic converters to motor vehicles and standards on fleet fuel consumption, to a greater emphasis on changes in fuel composition. The first changes eliminated lead based octane enhancing additives in gasoline. More recently, compositional changes to gasoline dictated by environmental considerations include the reduction of low boiling hydrocarbon components, reduction in benzene content of gasoline and a requirement to substantially increase the oxygen content of formulated gasoline. Further regulations can be expected in the future, probably including regulations stipulating a reduction in the ASTM Distillation End Point of gasoline. The sum of the required changes to date presents an unprecedented technological challenge to the petroleum industry to meet these requirements in a timely manner and with a product that maintains high octane value and is economically acceptable in the marketplace.

Gasolines manufactured to contain a higher concentration of aromatics such as benzene, toluene and xylenes (BTX) can adequately meet the octane requirements of the marketplace for a high octane fuel. Aromatics, particularly benzene, are commonly produced in refinery processes such as catalytic reforming which have been a part of the conventional refinery complex for many years. However, their substitution for the environmentally unsuitable lead octane enhancers is complicated by environmental problems of their own. Environmental and health related studies have raised serious questions regarding the human health effects of benzene. The findings suggest that exposure to high levels of benzene should be avoided with the result that benzene concentration in gasoline to enhance octane number is limited and controlled to a relatively low value. Alkylated aromatics, such as toluene and xylenes do not suffer under the same health effects liabilities as benzene and can be readily used for their octane enhancing properties.

When hydrocarbons boiling in the gasoline boiling range are reformed in the presence of a hydrogenation-dehydrogenation catalyst, a number of reactions take place which include dehydrogenation of naphthenes to form aromatics, dehydrocyclization of paraffins to form aromatics, isomerization reactions and hydrocracking reactions. The composition of the reformer effluent or reformate is shifted toward higher octane value product. Catalytic reforming primarily increases the octane of motor gasoline by aromatics formation but without increasing the yield of gasoline.

Reformates can be prepared by conventional techniques by contacting any suitable material such as a naphtha charge material boiling in the range of $C_5$ or $C_6$ up to about 380° F. (193° C.) with hydrogen in contact with any conventional reforming catalyst. Typical reforming operating conditions include temperatures in the range of from about 800° F. (427° C.) to about 1000° F. (538° C.) , preferably from about 890 (477° C.) up to about 980° F. (527° C.), liquid hourly space velocity in the range of from about 0.1 to about 10, preferably from about 0.5 to about 5; a pressure in the range of from about atmospheric up to about 700 psig (4900 kPa) and higher, preferably from about 100 (700 kPa) to about 600 psig (4200 kPa); and a hydrogen-hydrocarbon ratio in the charge in the range from about 0.5 to about 20 and preferably from about 1 to about 10.

The treatment of a reformate with crystalline aluminosilcate zeolites is known in the art and has included both physical treatments such as selective adsorption, as well as chemical treatments such as selective conversion thereof. In U.S. Pat. No. 3,770,614 to Graven a process combination is described for upgrading naphtha boiling range hydrocarbons by a combination of catalytic reforming and selective conversion of paraffinic components to enhance yield of aromatic hydrocarbons by contact with crystalline aluminosilicate catalyst having particular conversion characteristics. In U.S. Pat. No. 3,649,520 to Graven a process is described for the production of lead free gasoline by an integrated process of reforming, aromatics recovery and isomerization including $C_6$ hydrocarbons upgrading to higher octane product for blending.

U.S. Pat. No. 3,767,568 to Chen, incorporated herein by reference, discloses a process for upgrading reformates and reformer effluents by contacting them with specific zeolite catalysts so as to sorb methyl paraffins at conversion conditions and alkylate a portion of aromatic rings contained in the reformates.

It is an object of the present invention to provide a process for the manufacture of high octane lead free gasoline containing a reduced amount of benzene and lower ASTM Distillation End Point.

A further object of the invention is to provide a process for upgrading reformate and/or light FCC gasoline by substantially reducing the amount of benzene in the gasoline product while simultaneously reducing Reid vapor pressure (RVP) obtained and the gasoline ASTM distillation End Point.

Another object of the present invention is to provide a process for the manufacture of high octane gasoline from reformate by maximizing the formation of alkylaromatics produced by transalkylation or alkylation of benzene and employing acidic metallosilicate as alkylation catalyst.

Yet another object of the present invention is to provide a process wherein the benzene fraction of reformate is recycled to a conversion zone under condition that promote alkylation and/or transalkylation with higher molecular weight aromatic components of the reformate.

Summary of the Invention

A process is disclosed for upgrading reformate and/or light FCC gasoline by substantially reducing the amount of benzene in the gasoline product while simultaneously reducing the gasoline ASTM distillation End Point. The process comprises the fractionation of reformate to recover that fraction, $C_7$–$C_8$ or $C_7$–$C_9$ hydrocarbons, directly useful in gasoline without further conversion. A heavy bottom fraction comprising $C_9$+ or $C_{10}$+ aromatic and non-aromatic hydrocarbons is recovered and a $C_6$ fraction rich in benzene. At least a fraction of the $C_6$ fraction and a portion of the $C_9$+ fraction are converted by alkylation, transalkylation and cracking in contact with acidic metallosilicate catalyst particles to gasoline boiling range materials rich in alkylaromatics. Following debutanization or depentanization of the conversion product, the fraction containing unconverted benzene is recycled to the reformate fractionator.

More particularly, a process for the production of gasoline having reduced benzene content and lower boiling end point has been discovered which comprises introducing a reformer effluent into a fractionation tower for separation and recovery of an overhead stream comprising $C_6$− hydrocarbons, a bottom stream comprising $C_9$+ or $C_{10}$+ alkylaromatic rich hydrocarbons, a stream comprising benzene rich $C_6$hydrocarbons, and a stream comprising $C_7$–$C_8$ or $C_7$–$C_9$hydrocarbons. The benzene rich $C_6$ stream and a portion of said $C_9$+ hydrocarbon stream is passed to a hydrocarbon cracking and alkylation reactor containing acidic shape selective metallosilicate catalyst particles under cracking, alkylation and transalkylation conversion conditions whereby a portion of benzene is converted to $C_7$+ alkylaromatics and a portion of $C_9$+ or $C_{10}$+ hydrocarbons is converted to lower molecular weight hydrocarbons. The effluent from said reactor is recycled to the fractionation tower to separate and recycle unconverted benzene and unconverted $C_9$+ hydrocarbons whereby the production of $C_7$–$C_8$ or $C_7$–$C_9$ alkylaromatics is maximized.

The invention further comprises a process for the combined upgrading of reformate and light $C^5$+ olefinic gasoline to provide gasoline having reduced benzene RVP and olefins content. For this embodiment light $C_5$+ olefinic gasoline such as light fluid catalytic cracking (FCC) gasoline is introduced as a cofeedstream into the conversion reaction. The benzene in the FCC gasoline is alkylated while the olefins concentration is lowered.

DESCRIPTION OF THE FIGURE

The Figure is a schematic drawing of a preferred embodiment of the process of the invention.

DETAIL DESCRIPTION OF THE INVENTION

Figure 1:
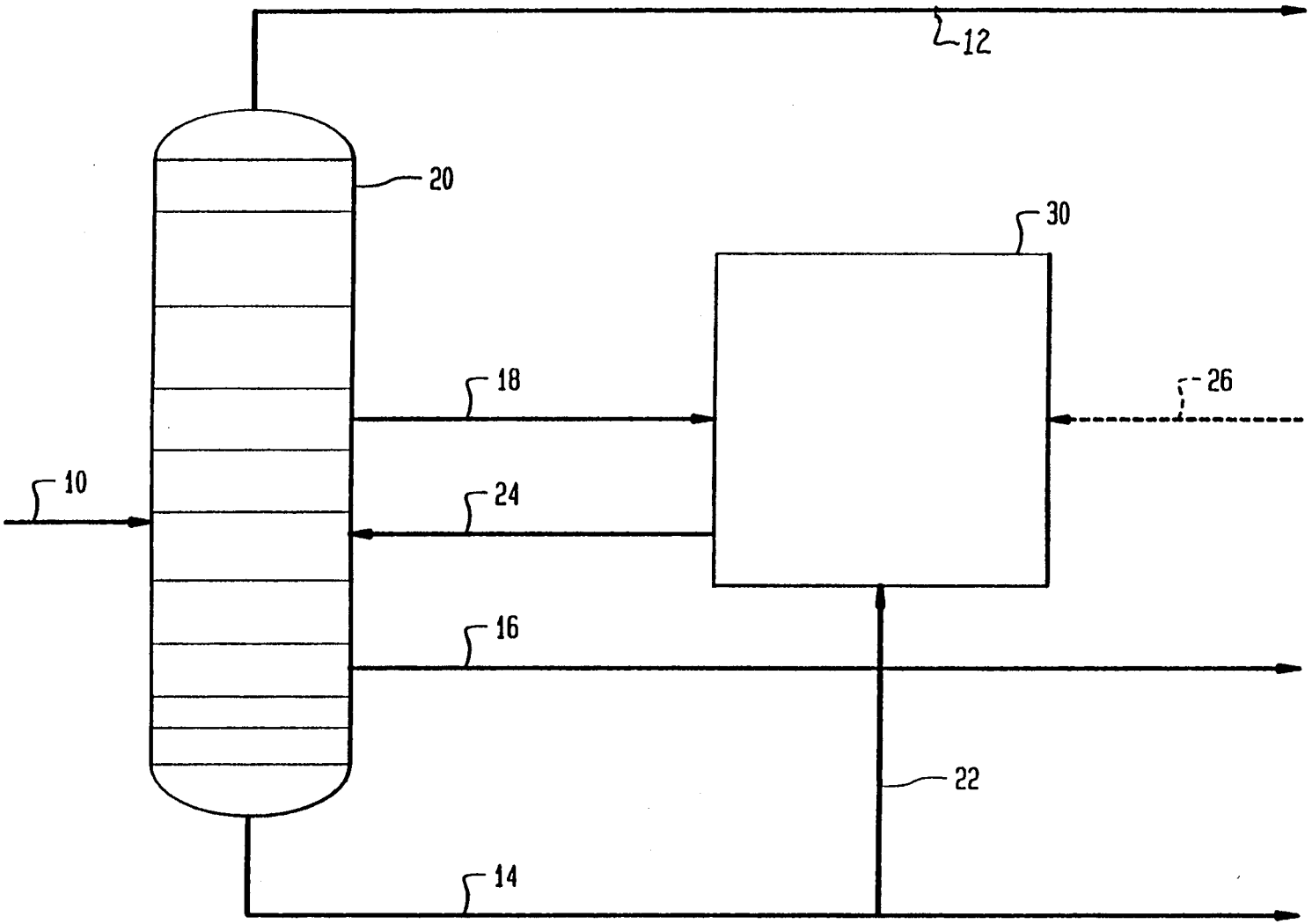

The present invention provides a process for lowering the benzene content and the ASTM distillation end point of any benzene rich $C_5$+ gasoline boiling range hydrocarbon feedstream. In a preferred embodiment the invention provides a process integrated into the reformer section of a refinery for the manufacture of high octane gasoline. The invention can improve the economics of meeting the benzene specification of the gasoline pool, preferably reducing the pool benzene content below 1% or 0.8%. An additional advantage of the invention is a reduction in the ASTM Distillation End Point of the gasoline produced by the process.

One novel aspect of the process of this invention resides in the conversion of a portion of a reformate or reformer effluent, or any benzene rich $C_5$+ gasoline feedstream, following fractionation in a fractionation system. Portions subjected to conversion in the process are the $C_6$ fraction and at least a portion of the $C_9$+ or $C_{10}$+ fraction of the reformate containing aromatic and non-aromatic compounds. The conversion is carried out at conversion conditions with or without added hydrogen over a shape selective metallosilicate catalyst, preferably aluminosilicate.

Reformates or reformer effluents which are composed substantially of paraffinic and aromatic constituents can be prepared according to conventional techniques by contacting any suitable material such as naphtha charge material or heavy straight run gasoline boiling in the range of $C_5$ and preferably in the range of $C_6$ up to about 400° F. (204° C.) and higher with hydrogen at least initially in contact with any reforming catalyst. This is a conventional reforming operation which involves a net production of hydrogen and is well known to those skilled in the art as described in Chapter 6 of Petroleum Refining by James H. Gray and Glenn E. Handwerk as Published by Marcel Dekker, Inc. (1984).

Reforming catalysts in general contain platinum supported on a silica or silica-aluminum base. Preferably, rhenium is combined with platinum to form a more stable catalyst which permits operation at lower pressures. It is considered that platinum serves as a catalytic site for hydrogenation and dehydrogenation reactions and chlorinated alumina provides an acid site for isomerization, cyclization, and hydrocracking reactions. Some impurities in the feed such as hydrogen sulfide, ammonia and organic nitrogen and sulfur compounds will deactivate the catalyst. Accordingly, feed pretreating in the form of hydrotreating is usually employed to remove these materials. Typically feedstock and reforming products or reformate have the following analysis:

TABLE 1

| COMPONENT (vol %) | FEED | PRODUCT |
|---|---|---|
| Paraffins | 45–55 | 30–50 |
| Olefins | 0–2 | 0 |
| Naphthenes | 30–40 | 5–10 |
| Aromatics | 5–10 | 45–60 |

Reforming operating conditions include temperatures in the range of from about 800° F. (427° C.) to about 1000° F. (538° C.), preferably from about 890 (477° C.) up to about 980 ° F. (527° C.), liquid hourly space velocity in the range of from about 0.1 to about 10, preferably from about 0.5 to about 5; a pressure in the range of from about atmospheric up to about 700 psig (4900 kPa) and higher, preferably from about 100 (700 kPa) to about 600 psig (4200 kPa); and a hydrogen-hydrocarbon ratio in the charge in the range from about 0.5 to about 20 and preferably from about 1 to about 10.

An important aspect of the present invention is the incorporation of a process step comprising the fractionation of the reformate or reformer effluent, or $C_5$+ hydrocarbon feedstream. The fractionation step permits separation of the reformer effluent into at least four fractions. These streams include an overhead stream comprising $C_5$− or $C_6$− hydrocarbons low in benzene content; a $C_7$–$C_8$ hydrocarbon fraction which is a stream that can be used without further conversion in a gasoline pool; and two additional fractions including a $C_6$ hydrocarbon fraction rich in benzene and a fractionator tower bottom stream consisting of $C_9$+ aromatic rich hydrocarbons. These latter streams contain components of reformate that compromise the environmental acceptability of that product. It has been discovered in the present invention that all or a portion of these streams can be coprocessed in a conversion zone containing shape selective aluminosilicate catalyst particles to upgrade these components to environmentally acceptable and high octane value gasoline constituents.

While not wanting to be bound by a theory of operation it appears that in the present invention when the benzene rich stream is coprocessed with the $C_9+$ hydrocarbon stream over shape selective zeolite catalyst particles several reactions occur under the conversion condition employed that lead to a substantial reduction in the benzene content of the product of the process and, simultaneously, a reduction in the distillation end point. These reactions, it is believed, include cracking, alkylation, and transalkylation. The $C_9+$ fraction containing aromatic and non-aromatic compounds, such as dialkylated aromatics, can enter into transalkylation reactions with benzene under the conditions of the process leading to the formation of $C_7$–$C_8$ alkylate aromatics from benzene. Also, cracking paraffins, particularly higher molecular weight normal and slightly branched paraffins, results in the production of compounds that are effective in alkylating benzene and further producing alkylated aromatics under the conditions of the conversion process.

While the alkylation of benzene in a once through process would be substantially incomplete and may lack in utility, it has been discovered that when the effluent from the conversion step is be passed or recycled to the fractionator tower the alkylation of benzene can be maximized. Here , the newly formed $C_7$–$C_8$ alkylated aromatic rich components can be separated while unconverted benzene can be recycled to the conversion reactor. Uniquely, by recycling products from the conversion step the alkylation of benzene can be substantially advanced to equilibrate the production of the preferred high octane value $C_7$–$C_8$ alkylaromatics.

Conversion of the $C_6$ and $C_9+$ streams in contact with metallosilicate catalyst particles according to the present process is generally carried out at a temperature between 500° F. (260° C.) and about 1000° F. (538° C.) preferably between 550°–850° F. (288°–454° C.) and most preferably between 700°–850° F. (371°–454° C.). The pressure is generally between about 50 (350 kPa) and 3000 psig (21000 kPa), preferably between 50–200 psig (350–1400 kPa). The liquid hourly space velocity, i.e., the liquid volume of hydrocarbon per hour per volume of catalyst is about 0.1 and about 250, and preferably between about 1 and 100. If hydrogen is charged, the molar ratio of hydrogen to hydrocarbon charged can be as high as 10 but it is preferably zero.

Developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such Al, Ga, or Fe, within the zeolytic framework. These medium pore zeolites are favored for acid catalysis; however, the advantages of ZSM-5 structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

The catalysts preferred for use in the conversion step of the present invention include the crystalline aluminosilicate zeolites having a silica to alumina ratio of at least 12, and constraint index of about 1 to 12. Representative of the ZSM-5 type zeolites are ZSM-5, ZSM-11, ZSM-12, ZSM-22, ZSM-23, ZSM-35, zeolite Beta, MCM-22, MCM-36, MCM-49 and ZSM-48. ZSM-5 is disclosed and claimed in U.S. Pat. No. 3,702,886 and U.S. Pat. No. Re. 29,948; ZSM-11 is disclosed and claimed in U.S. Pat. No. 3,709,979.

The larger pore zeolites which are useful as catalysts in the process of this invention, i.e., those zeolites having a Constraint Index of no greater than about 2, are well known to the art. Representative of these zeolites are zeolite Beta, TEA mordenite and ZSM-12.

Zeolite Beta is described in U.S. Reissue Pat. No. 28,341 (of original U.S. Pat. No. 3,308,069), to which reference is made for details of this catalyst.

Zeolite ZSM-12 is described in U.S. Pat. No. 3,832,449, to which reference is made for the details of this catalyst.

The method by which Constraint Index is determined is described fully in U.S. Pat. No. 4,016,218, to which reference is made for details of the method.

Referring now to the Figure, a schematic diagram of a preferred embodiment of the invention is depicted. Reformate 10 or the effluent from a catalytic reformer or known aromatization process such as M2 Forming or M-Forming is introduced to a mid-portion of fractionator tower 20. In the fractionator an overhead stream 12 comprising $C_5-$ or $C_6-$ hydrocarbons is separated, as well as a bottom stream 14 comprising $C_9+$ hydrocarbons containing aromatics and non-aromatics, a stream 16 comprising $C_7$–$C_8$ hydrocarbons and stream 18 comprising $C_6$ benzene rich fraction of the reformate 10 feedstream. The benzene rich stream 18 and a portion of the $C_9+$ hydrocarbon stream 22 are passed to a conversion zone containing shape selective zeolite catalyst particles under alkylation, transalkylation and/or cracking conditions described herein before. Under these conditions a portion of the benzene contained in stream 18 is alkylated to produce alkylaromatics and a portion of the high molecular weight hydrocarbons contained in stream 14 are converted to provide lower molecular weight products. The effluent 24 from the zeolite conversion zone 30, preferably after it is debutanized, is recycled to the fractionation zone 20. $C_7$–$C_8$alkylaromatics produced in the zone 30 are recovered in stream 16 and unconverted benzene is recycled via stream 18 to the conversion zone 30.

Still referring to the Figure, another variation of the process of the invention embodies the introduction of feedstream 26 into the reactor 30 either in conjunction with the aforenoted products from the distillation of reformate. In this instance stream 26 comprises preferably a light $C_5+$ olefinic gasoline such as light FCC gasoline. For this embodiment the olefin content of FCC gasoline benzene alkylation. Also, this embodiment provides an economic means to reduce the amount of benzene in light FCC gasoline by alkylation in the conversion zone 30. This embodiment reduces RVP and olefin content of the gasoline stream 26. Optionally, stream 26 can enter the plant through fractionator 20.

A further option in the present invention includes the embodiment wherein the feedstream to the conversion zone 30 consists of light FCC gasoline only with no upgrading of reformate.

The following Examples illustrate the process of the instant invention.

EXAMPLE 1

A 50/50 weight percent mixture of Light reformate and $C_5-215°$ F. FCC gasoline is converted over zeolite catalyst at 800° F. and 75 psig at a weight hourly space velocity (WHSV) of 1.5. The feed contains 125 ppm of sulfur. In Table 2 the composition of the product stream is depicted after approximately 2 hours on stream and compared to the composition of the feed.

An inspection of Table 2 indicates that the process of the instant invention as carried out in Example 1 results in a conversion of 32% for benzene and produces $C_5+$ product with a substantial increase in octane value.

TABLE 2

| Light Reformate Plus Light FCC Gasoline Feed, 50/50 | | |
|---|---|---|
| Composition (weight %) | Feed | Product |
| $C_2$- | 0.0 | 0.6 |
| Propane | 0.0 | 2.8 |
| Propylene | 0.0 | 0.8 |
| Butanes | 0.3 | 5.8 |
| Butenes | 1.0 | 1.9 |
| n-pentane | 2.5 | 3.1 |
| Isopentane | 5.4 | 7.0 |
| Pentenes | 8.7 | 1.7 |
| Cyclopentane | 1.3 | 1.0 |
| $C_6$ saturates | 32.9 | 28.5 |
| $C_6$ olefins | 8.1 | 1.0 |
| $C_7$ saturates | 8.9 | 8.0 |
| $C_7$ olefins | 4.4 | 1.0 |
| $C_8$ PON | 2.0 | 2.1 |
| $C_9$ PON | 0.1 | 2.0 |
| $C_{10}$ PON | 0.0 | 0.7 |
| Benzene | 21.2 | 14.3 |
| Toluene | 3.1 | 4.1 |
| $C_8$ aromatics | 0.1 | 3.3 |
| $C_9$ aromatics | 0.0 | 5.3 |
| $C_{10}+$ | 0.0 | 5.6 |
| $C_5+$ RON | 86.7* | 89.0 |
| $C_5+$ MON | 79.1* | 82.8 |
| $C_5+$ SG | 0.71 | 0.73 |
| Sulfur Conversion to $H_2S$ % | — | 33 |
| Benzene conversion, % | — | 32 |

*incl. 1.3 weight % $C_4$'s

EXAMPLE 2

A light FCC gasoline is converted over zeolite catalyst at 750° F. 75 psig an a WHSV of 1. In Table 3 the results are presented for the composition of the product after 2.5 hours on stream and compared to the composition of the feed.

TABLE 3

| Light FCC Gasoline Feed, | | |
|---|---|---|
| Composition (weight %) | Feed | Product |
| $C_2$- | 0.0 | 0.6 |
| Propane | 0.0 | 5.0 |
| Propylene | 0.0 | 1.1 |
| Butanes | 3.9 | 8.6 |
| Butenes | 3.5 | 2.7 |
| n-pentane | 3.5 | 4.5 |
| Isopentane | 11.4 | 13.7 |
| Pentenes | 19.2 | 2.8 |
| Cyclopentane | 0.5 | 0.5 |
| $C_6$ saturates | 18.6 | 18.3 |
| $C_6$ olefins | 14.8 | 1.4 |
| $C_7$ saturates | 8.0 | 7.9 |
| $C_7$ olefins | 9.3 | 1.9 |
| $C_8$ PON | 3.7 | 4.2 |
| $C_9$ PON | 0.3 | 3.3 |

TABLE 3-continued

| Light FCC Gasoline Feed, | | |
|---|---|---|
| Composition (weight %) | Feed | Product |
| $C_{10}$ PON | 0.0 | 0.5 |
| Benzene | 2.3 | 2.1 |
| Toluene | 3.4 | 5.1 |
| $C_8$ aromatics | 0.1 | 4.5 |
| $C_9$ aromatics | 0.0 | 5.0 |
| $C_{10}+$ | 0.1 | 5.1 |
| $C_5+$ RON | 91.0* | 91.0 |
| $C_5+$ MON | 79.7* | 82.1 |
| $C_5+$ RVP, psia | — | 8.1 |
| $C_5+$ SG | 0.68 | 0.71 |

*includes 4–5 wt % $C_4$'s

One additional option available in the process of the instant invention concerns the utilization of the $C_3$–$C_4$ hydrocarbon product. This product fraction can be alkylated.

While the invention has been described by reference to specific embodiments there is no intent to limit the scope of the invention except to describe in the following claims.

What is claimed is:

1. A process for the production of gasoline having reduced benzene content and lower boiling end point, comprising:

a) introducing reformer effluent into a fractionation system for separation and recovery of an overhead stream comprising $C_5-$ hydrocarbons, a bottom stream comprising $C_9+$ alkylaromatic and non-aromatic hydrocarbons, a stream comprising benzene rich $C_6$ hydrocarbons, and a stream comprising $C_7$–$C_8$ hydrocarbons;

b) passing said benzene rich $C_6$ stream and a portion of said $C_9+$ hydrocarbon stream to a hydrocarbon cracking and alkylation reactor containing acidic shape selective metallo-silicate catalyst particles under cracking, alkylation and transalkylation conversion conditions whereby a portion of said benzene is converted to $C_7+$ alkylaromatics and a portion of said $C_9+$ hydrocarbons is converted to lower molecular weight hydrocarbons;

c) recycling effluent from said reactor to said fractionation tower to separate and recycle unconverted benzene and unconverted $C_9+$ hydrocarbons whereby the production of $C_7$–$C_9$ alkylaromatics is maximized.

2. The process of claim 1 including the further step of separating said effluent by first passing said effluent to a debutanizer or depentanizer and recycling said debutanizer or depentanizer $C_5+$ or $C_6+$ bottom stream to said fractionation tower.

3. The process of claim 1 wherein said conversion conditions comprise temperature between 300° C. and 500° C., pressure between 100 kPA and 1400 kPa and weight hourly space velocity between 0.1 and 10.

4. The process of claim 3 wherein said conversion conditions comprise temperature between 370° C. and 455° C., pressure between 350 kPa and 700 kPa and weight hourly space velocity between 1 and 5.

5. The process of claim 1 wherein said catalyst comprises crystalline aluminosilicate.

6. The process of claim 5 wherein said catalyst is selected from the group consisting of ZSM-5, ZSM-11, ZSM-12, ZSM-22, ZSM-23, ZSM-35, ZSM-48, MCM-22, MCM-36, zeolite Beta and TEA mordenite.

7. The process of claim 1 wherein said reformer effluent is separated into an overhead stream comprising $C_6-$ hydrocarbons, a bottom stream comprising $C_{10}+$ alkylaromatic and non-aromatic hydrocarbons, and a stream comprising $C_7$–$C_9$ hydrocarbons, whereby a portion of said $C_{10}+$ alkylaromatic and non-aromatic hydrocarbons is converted to lower molecular weight hydrocarbons.

8. The process of claim 1 including introducing into said reactor an additional feedstream comprising $C_5$–$C_6$ oleflnic gasoline containing less than 3 weight percent benzene whereby said benzene is converted to $C_7+$ aikylaromatics and olefin content of said gasoline is reduced.

9. A process for the combined upgrading of reformate and light $C_5+$ olefinic gasoline to provide low boiling end point gasoline having reduced benzene and olefins content, comprising:

a) introducing reformer effluent into a fractionation tower for separation and recovery of an overhead stream comprising $C_6-$ hydrocarbons, a bottom stream comprising $C_9+$ alkylaromatic and non-aromatic hydrocarbons , a stream comprising benzene rich $C_6$ hydrocarbons, and a stream comprising $C_7$–$C_8$ hydrocarbons;

b) passing said benzene rich $C_6$ stream, a portion of said $C_9+$ hydrocarbon stream and a feedstream comprising $C_5+$ light olefinic gasoline to a hydrocarbon cracking and alkylation reactor containing acidic shape selective metallosilicate catalyst particles under cracking, alkylation and transalkylation conversion conditions whereby a portion of said benzene is converted to $C_7+$ alkylaromatics, a portion of said $C_9+$ hydrocarbons is converted to lower molecular weight hydrocarbons and olefins are lowered;

c) recycling effluent from said reactor to said fractionation tower to separate and recycle unconverned benzene and unconverted $C_9+$ hydrocarbons whereby the production of $C_7$–$C_9$ alkylaromatics is maximized.

10. The process of claim 9 including the further step of separating said effluent by first passing said effluent into a debutanizer or depentanizer and recycling said debutanizer or depentanizer $C_5+$ or $C_6+$ bottom stream to said fractionation tower.

11. The process of claim 9 wherein said conversion conditions comprise temperature between 300° C. and 500° C., pressure between 100 kPA and 1400 kPa and weight hourly space velocity between 0.1 and 10.

12. The process of claim 11 wherein said conversion conditions comprise temperature between 370° C. and 455° C., pressure between 350 kPa and 700 kPa and weight hourly space velocity between 1 and 5.

13. The process of claim 9 wherein said catalyst comprises crystalline aluminosilicate.

14. The process of claim 13 wherein said catalyst is selected from the group consisting of ZSM-5, ZSM-11 , ZSM-12, ZSM-23, ZSM-35, ZSM-48, zeolite Beta and TEA mordenite.

15. A process for the production of $C_5+$ gasoline having reduced benzene content and lower boiling end point, comprising:

(a) introducing a feedstream comprising $C_5+$ gasoline boiling range olefinic hydrocarbons rich in benzene and $C_9+$ alkylaromatic hydrocarbons into a hydrocarbon cracking and alkylation reactor containing acidic shape selective metallosilicate catalyst particles under cracking, alkylation and transalkylation conversion conditions whereby a portion of said benzene is converted to $C_7+$ alkylaromatics and a portion of said $C_9+$ hydrocarbons is converted to lower molecular weight hydrocarbons;

(b) introducing effluent from said reactor into a fractionation system for separation and recovery of an overhead stream comprising $C_4-$ or $C_5-$ hydrocarbons, a bottom stream comprising $C_9+$ alkylaromatic rich hydrocarbons, a stream comprising benzene rich $C_6$ hydrocarbons, and a stream comprising $C_7$–$C_8$ hydrocarbons;

c) recycling a portion of said bottom stream and a portion of said fractionator $C_6$ hydrocarbon stream to said reactor.

16. The process of claim 15 wherein said conversion conditions comprise temperature between 300° C. and 500° C., pressure between 100 kPA and 1400 kPa and weight hourly space velocity between 0.1 and 10.

17. The process of claim 16 wherein said conversion conditions comprise temperature between 370° C. and 455° C., pressure between 350 kPa and 700 kPa and weight hourly space velocity between 1 and 5.

18. The process of claim 15 wherein said catalyst comprises crystalline aluminosilicate.

19. The process of claim 18 wherein said catalyst is selected from the group consisting of ZSM-5, ZSM-11, ZSM-12, ZSM-22, ZSM-23, ZSM-35, ZSM-48, MCM-22, MCM-36, zeolite Beta and TEA mordenite.

* * * * *